US010329051B2

(12) United States Patent
Gotschi

(10) Patent No.: US 10,329,051 B2
(45) Date of Patent: Jun. 25, 2019

(54) DRIP STOPPER AND PACKAGING THEREFOR

(71) Applicant: Rudolf Gotschi, Brislach (CH)

(72) Inventor: Rudolf Gotschi, Brislach (CH)

( * ) Notice: Subject to any disclaimer, the term of this patent is extended or adjusted under 35 U.S.C. 154(b) by 0 days.

(21) Appl. No.: 15/548,127

(22) PCT Filed: Jan. 14, 2016

(86) PCT No.: PCT/EP2016/050625
§ 371 (c)(1),
(2) Date: Aug. 2, 2017

(87) PCT Pub. No.: WO2016/124365
PCT Pub. Date: Aug. 11, 2016

(65) Prior Publication Data

US 2018/0009568 A1 Jan. 11, 2018

(30) Foreign Application Priority Data

Feb. 2, 2015 (CH) ..... 0123/15

(51) Int. Cl.
*B65D 23/06* (2006.01)
*B65D 5/50* (2006.01)

(52) U.S. Cl.
CPC ..... *B65D 23/065* (2013.01); *B65D 5/503* (2013.01)

(58) Field of Classification Search
CPC ..... B65D 23/065; B65D 23/06; B65D 25/48; B65D 25/42; B65D 5/503; B65D 1/023; B65D 1/0223; B65D 39/0058; B65D 39/00; A47G 19/2211; A47G 19/2205; A47G 19/2216
USPC ..... 215/392, 387, 386, 41, 364, 355; 220/719, 716, 703, 804, 803, 802, 801; 222/569, 567, 566, 563, 544
See application file for complete search history.

(56) References Cited

U.S. PATENT DOCUMENTS 184,315 A * 11/1876 Armstrong ..... B65D 47/18 222/421
2,272,549 A * 2/1942 Deschner ..... B65D 47/40 215/200
2,317,046 A * 4/1943 Fleming ..... B65D 41/12 215/307
2,649,090 A * 8/1953 Parsons ..... B65D 39/00 215/355
2,750,063 A * 6/1956 Opsitnik ..... B65D 23/065 222/571
2,763,402 A * 9/1956 Livingstone ..... B65D 47/122 222/109
2,848,145 A * 8/1958 Livingstone ..... B65D 47/40 215/392

(Continued)

FOREIGN PATENT DOCUMENTS

NL 1020238 C1 9/2003

*Primary Examiner* — Robert J Hicks
(74) *Attorney, Agent, or Firm* — Hammer & Associates, P.C.

(57) ABSTRACT

A drip stopper for preventing the undesired falling of drops during pouring includes a substantially cylindrical wall having an insertion part for inserting into a bottleneck, and a pouring-out part. The wall has an axially parallel set-back in the form of a recess which extends over the axial length of the wall and makes is possible to adapt the drip stopper to bottlenecks of different widths.

8 Claims, 4 Drawing Sheets

(56) References Cited

U.S. PATENT DOCUMENTS

| | | | | | |
|---|---|---|---|---|---|
| 2,908,426 | A * | 10/1959 | Goldstein | B65D 47/063 | 215/309 |
| 3,217,935 | A * | 11/1965 | Burt | B65D 47/061 | 222/109 |
| 4,222,504 | A * | 9/1980 | Ackerman | B65D 23/065 | 222/569 |
| 4,501,361 | A | 2/1985 | Rose, Jr. | | |
| 5,435,467 | A * | 7/1995 | Ekkert | B65D 47/122 | 222/109 |
| 7,097,076 | B1 * | 8/2006 | Giblin | B65D 47/40 | 222/109 |
| 7,407,067 | B2 * | 8/2008 | Kerkhof | B65D 23/065 | 222/109 |
| 8,091,746 | B2 * | 1/2012 | Gotler | B65D 41/3447 | 215/41 |
| 8,459,513 | B2 * | 6/2013 | Harrower | B65D 47/043 | 220/378 |
| 2017/0320641 | A1 * | 11/2017 | Geiger | B65D 47/18 | |

* cited by examiner

DRIP STOPPER AND PACKAGING THEREFOR

FIELD OF THE INVENTION

The invention relates to a drip stopper for preventing the undesired falling of drops during pouring from a bottle, particularly a wine bottle, into a drinking vessel or the like.

BACKGROUND OF THE INVENTION

The problem of undesired drops during pouring from bottles into glasses is known from the food service industry and the private domain. Frequently, due to a single drop of red wine, an otherwise clean table cloth must be changed. In order to solve this problem, different inserts or attachments in or on a bottleneck have been described in the prior art.

The international patent application PCT/EP 2012/061880 describes an insertion device for drip stoppers and thin-walled drip stoppers, having short thin lamellas for sealing to be used with this insertion device. Even though these drip stoppers serve the intended purpose, it has become apparent that they are difficult to produce and are thus too expensive.

The problem addressed by the invention is that of providing a drip stopper that overcomes the above disadvantages and offers additional advantages.

SUMMARY OF THE INVENTION

This problem is solved by the initially described drip stopper with the characterizing features of claim 1.

The drip stopper according to the invention offers the technical possibilities of use in the packaging described below as well as in an insertion device as described in the aforementioned patent application. The drip stopper, designed as one-piece, is made of resilient plastic which is permitted for the use with foodstuff, e.g. PE. An elastic folding device makes it possible that the diameter of the drip stopper can be changed progressively. The drip stopper is thus universally suitable for bottlenecks with different inner diameters, e.g. from 17 mm to 19.5 mm. It is short and can be inserted into other drip stoppers to save space. In addition, it is stackable and can be adjusted to the aforementioned insertion device. It is simple to produce and use, also as a disposable article.

DESCRIPTION OF THE DRAWINGS

In the following, preferred embodiments shall be described using the attached drawings.

DESCRIPTION OF THE INVENTION

Figure 1A:
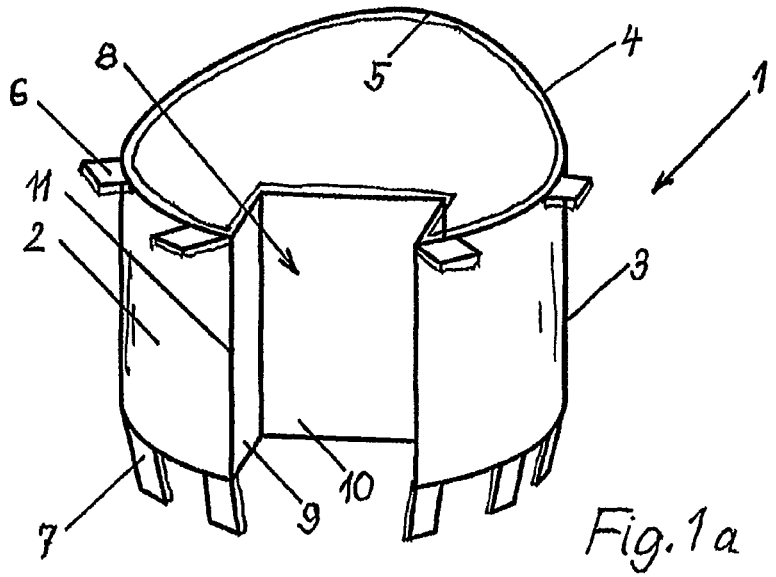
FIGS. 1*a* and 1*b* show schematic perspective depictions of a drip stopper according to the invention, namely a) in the operational state and b) in its inserted state.
Figure 1B:
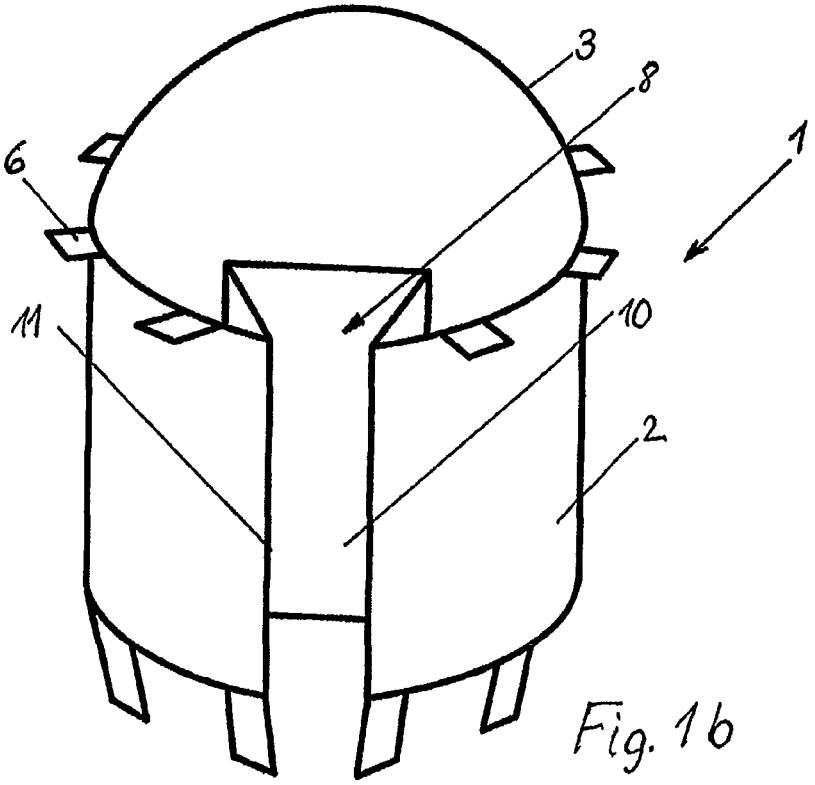

The drip stopper shown in FIG. 1 comprises a substantially cylindrical pipe part 1 which, for the purpose of drip-free pouring, is to some extent inserted in the neck of an opened bottle. The lower part of the pipe part in the drawing which, in its inserted state extends into the bottleneck, is denoted as insertion part 3, and the upper part which, in its inserted state protrudes from the bottleneck, is denoted as pouring-out part 4.

The upper opening of the pouring-out part 4 is shaped such that a defined pouring-out edge 4 is formed. In the present example, this is achieved by cutting the pipe part at the top at an angle to its axis. Between the pouring-out part 4 and the insertion part 3, a plurality of radially outwardly oriented position elements 6 are arranged which, in the inserted state of the drip stopper, rest on the upper edge of the bottleneck, thus delimiting the insertion depth. At the lower end section of the insertion part 3, a plurality of guide elements 7 are attached through molding. They are oriented downward obliquely to the axis of the insertion part 3 and facilitate the accurate insertion of the drip stopper in narrower bottlenecks.

On the side opposite of the pouring-out edge 5, the substantially cylindrical wall of the pipe part has a nook-shaped recess 8 which extends in axial direction over the entire length of the pipe part and is formed by two side walls 9 and a rear wall 10. As shall be explained in the following using FIG. 2, the front edges 11 of the recess, formed by the side walls with the lateral surface, are brought closer to one another by pressing together the cylindrical area. As a result, the recess folds up and shall in the following description thus also be denoted as folding zone 8.

FIG. 2*a* shows schematically a cross-section of the insertion part 3, i.e. a section perpendicular to the axis of the pipe part, with the preferred folding zone 8 in the operational basic position the way the drip stopper is delivered. In this basic position, the outer diameter of the insertion part 3 is minimally greater than the inner diameter of the largest bottleneck provided. When the drip stopper is inserted in the bottleneck, the insertion part 3 is narrowed. Simultaneously, the front edges 11 are pushed closer to one another.

The rear wall 10 is tensioned and slightly bent toward the axis of the insertion part 3. The tilting side walls 9 are forced to position themselves between the rear wall 10 and the outer wall. Inevitably, the rear wall 10 is also radially pulled outward, as can be seen in FIG. 2*b* which shows the state of the folding zone 8, when the drip stopper is inserted in a bottleneck with the smallest aforementioned diameter.

The force required to insert the drip stopper in the bottleneck generates a tension in the insertion part 3 as well as in the side walls 9 and the rear wall 10 of the folding zone 8. The functioning of the sealing is thus based on pressure and counter-pressure generated between the insertion part 3 and the folding zone 8 due to the narrowing when the drip stopper is pushed into the bottleneck. The angle adjustments between rear wall 10, side walls 9, and insertion part 3 determine, how and in which direction the side walls 9 must move, when the insertion part 3 is narrowed.

In order to ensure this function, primarily the pressing against the inner side of the bottleneck, it is necessary that the front edges 11 and the inner edges between rear wall 10 and the side walls 9 are able to transfer tension forces between the adjacent areas. In other words, they must not be bent so sharply that they can be folded free from tension. Preferably, this is achieved in that the edges have a curvature radius of a few millimeters.

Due to the narrowing of the insertion part 3, the folding zone 8 is tensioned, while this tension simultaneously presses the insertion part 3 everywhere and evenly against the bottleneck, thus generating a seal. As a result, no wine can penetrate between insertion part 3 and bottleneck.

Wine can also not flow through the area of the folding zone 8 because this is prevented by the backwards flowing air. In addition, if poured correctly, the wine only flows in the lower area of the passage.

Figure 3:
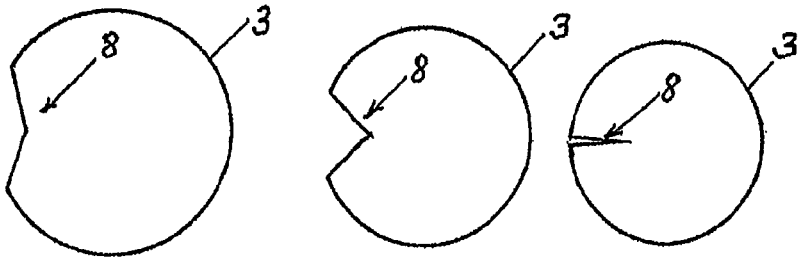
FIG. 3, 4 show schematic cross-sections of alternative versions of drip stoppers according to the invention in different states.

FIG. 3 shows another option for the design of a folding zone with an open angle, namely on the left side in an operational state, i.e. as delivered; in the middle with an approximately right-angled position of the folding zone in a bottleneck with medium inner diameter; and on the right in a bottleneck with the smallest inner diameter.

Figure 2:
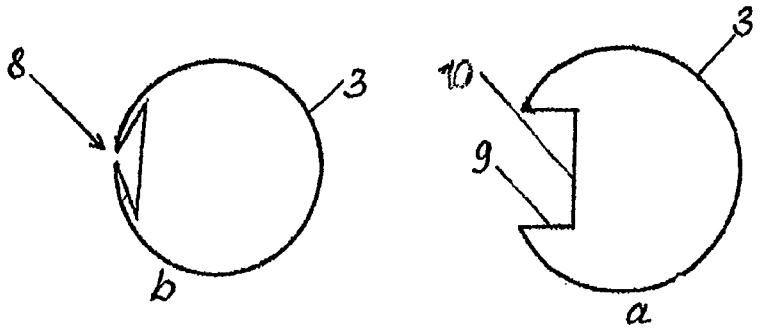
FIG. 2 shows schematic cross-sections of the same drip stopper in the two aforementioned states.
Figure 4:
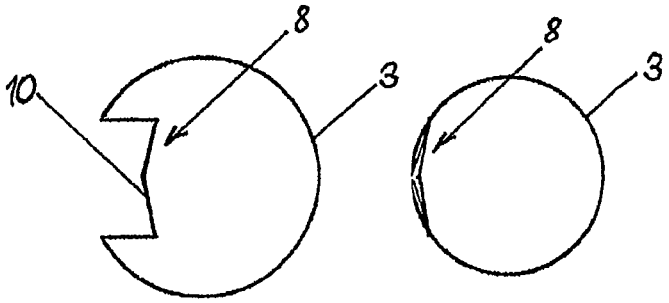

FIG. 4 shows a similar version as FIG. 2, but with an outwardly oriented bend in the rear wall 10. In this version, the rear wall 10 is pressed closer to the bottle wall when the insertion part 3 narrows than in the version according to FIG. 2.

The drip stoppers can be stacked by inserting one into another to save space. In order to make this possible, the following is provided:

The pouring-out part 4 has thinner walls than the insertion part 3. The inner diameter of the pouring-out part 4 corresponds approximately to the outer diameter of the insertion part 3. As a result, on the wall inner side between the pouring-out part and the insertion part, a continuous recess is created in the area, in which the position elements 6 are attached on the outside through molding. In the area of the pouring-out part 4, on the same level with the upper edge of the folding zone 8, a support is molded on the inside. The lower area of the insertion part is tapered in a short section in order to facilitate the insertion into the bottleneck. For the same length as said tapering, the folding zone 8 is omitted. The guide elements 7 are arranged such that they are located in the stack on the side of the folding zone 8 and the support. Therefore, when the drip stoppers are inserted into one another, the insertion part 3 of the upper drip stopper sits on the folding zone 8 and the support of the lower drip stopper. When stacked, a drip stopper only takes up space that is equal to the length of the insertion part 3.

The drip stopper is made of resilient, tough, hydrophobic plastic, e.g. PE.

There are several possibilities for designing the folding zone. For example, an inward bulge can be formed instead of the side walls and the rear wall. The principle remains the same.

Figure 5:
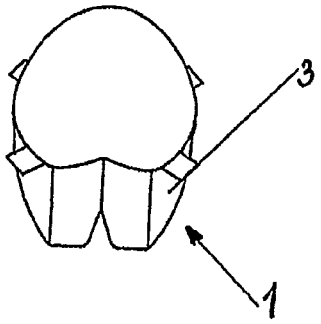
FIG. 5 shows a schematic depiction of another version of a drip stopper.

FIG. 5 shows a drip stopper, in which, contrary to the drip stopper with guide elements, the lower area of the insertion part is tapered. Due to this tapering, the accurate insertion of the drip stopper in the bottleneck with the smallest aforementioned diameter is facilitated. The rear wall or the apex of the folding zone is incised all the way to the end of the tapering. As a result, the tapering cannot influence the even contact pressure of the insertion part on the bottleneck.

Figure 6:
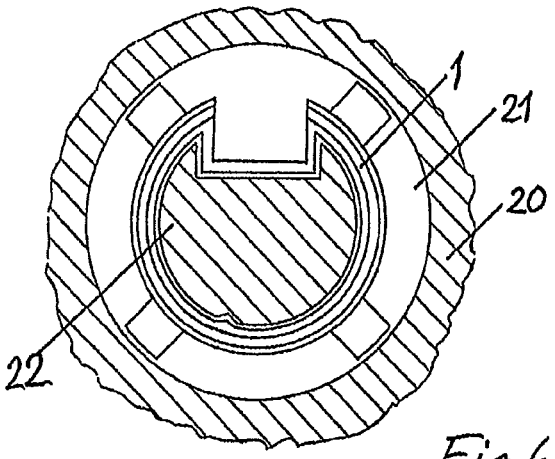
FIG. 6 shows a schematic sectional view of drip stoppers in a packaging.
Figure 7:
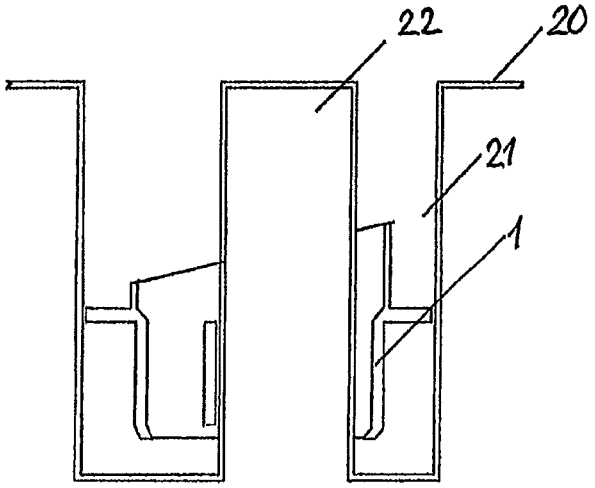
FIG. 7 shows a schematic axial section of a packaging.

FIGS. 6 and 7 schematically show a packaging, in which individual or stacked drip stoppers are stored without being able to be touched by fingers.

The packaging comprises a decorative, flat cardboard box with a folding lid, similar to a box of chocolates. In the interior, there is a foil 20 which is downwardly deep-drawn, having a flat surface. This foil 20 comprises a plurality of annular indentations as staking space 21, in which drip stoppers 1 can be stored individually or preferably stacked with the pouring-out parts 4 on top.

The outer diameter of this stacking space 21 corresponds approximately to the outer diameter of the circle of the end sections of the position elements 6. An also deep-draws column 22 if formed in the center of the stacking space 21, said column 22 being adjusted, at some distance, to the inner contours of the drip stopper 1. The column serves as an orientation element.

The drip stoppers 1 are thus oriented and stacked in the stacking space 21 at a depth, where they cannot be touched by fingers, i.e. a gap is formed between the surface of the packaging and the pouring-out edge 5 of the topmost drip stopper 1. The stacking space, in which the drip stoppers are located, is smaller than the thickness of a finger.

In the stack, the upper drip stopper 1 sits in the pouring-out part 4 of the corresponding subjacent drip stopper 1. The inner diameter of the pouring-out part 4 of each of the subjacent drip stoppers 1 corresponds, as mentioned before, approximately to the outer diameter of the insertion part of the next drip stopper 1 above, and so the upper drip stopper is held slightly by the subjacent drips stopper 1.

In the lower area, the indentations in the foil 20 are designed so as to be narrower than in the upper area. The lower area of the indentation is adjusted to the drip stopper such that the position elements 5 of the lowermost drip stopper are slightly clamped. Since, as a result, the drip stopper is pressed against the packaging, and the upper drip stoppers are held by the corresponding subjacent ones, there is no danger that the stack can slide out of the packaging, even if it is turned on its head.

Figure 8:
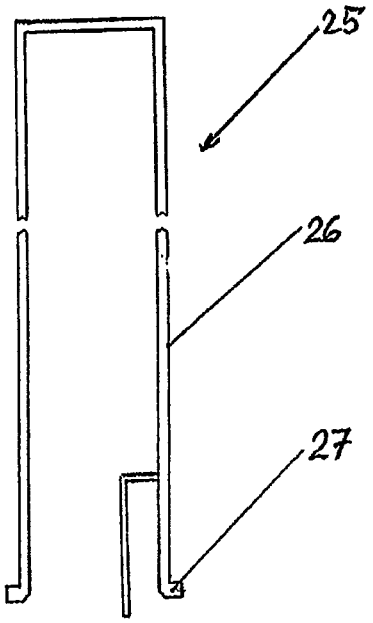
FIG. 8 shows a schematic sectional view of an insertion device for drip stoppers.

The insertion device 25 shown in FIG. 8 consists of a handle 26 and a push part 27. The handle 26 consists of a pipe which is open at the bottom and extends to the lower end section of the push part 27. The inner diameter of the pipe is minimally smaller than the outer diameter of the circle of the pouring-out part 2 of the drip stopper 1, when the drip stopper 1 is not tensioned. The outer diameter of the push part 27 is approximately equal to the outer diameter of the indentation in the foil 20 and somewhat smaller than the outer circle of the position elements 6 of the drip stopper 1. The lower end section of the pipe is cut straight and, similar to the lower surface of the push part 27, is positioned at a right angle to the axis of the pipe. At the bottom, the push part 27 is closed all the way to the edge of the pipe.

For removal from the packaging and insertion in the bottleneck, the insertion tool is gripped by the handle and the push part is guided into the annular indentation of the packaging, i.e. into the stacking space 21. In the indentation, a drip stopper 1 points upward with its pouring-out part 4. The pipe, having a short expansion in the lower section, is pulled over this pouring-out part 4. The pipe clamps the pouring-out part 4 of the drip stopper and holds it tight by pressing it together. Simultaneously, the circumference of the insertion part 3 of the drip stopper 1 is becoming smaller, and so it can come loose from the lower drip stopper. The pipe (handle) is lifted with the clamped pouring-out part 4. Now the drip stopper with the insertion device 25 is pressed into the bottleneck until the position elements 6 are positioned on the edge of the bottleneck. The drip stopper 1 is now securely positioned in the bottleneck.

Due to the pressing into the bottleneck, the diameter of the drip stopper 1 as well as the diameter of the pouring-out part 4 becomes smaller. The pouring-out part 4 thus comes loose from the insertion device 25. The insertion device 25 can be lifted and placed into the packaging, or a new drip stopper can be collected and inserted in a bottleneck.

In a different version, the pipe is supplemented by a flat section in the receiving space for the pouring-out part 4, said flat section being located in the interior of the insertion part 3, when receiving the drip stopper, and pressing slightly against the rear wall 10. This flat section can extend to the lower end section of the insertion part 3. This version is advantageous with a very short pouring-out part. Of course, the deep-drawn packaging foil 20 is adjusted.

The invention claimed is:

1. A drip stopper for preventing the undesired falling of drops during pouring from an opened bottle into a drinking vessel, the drip stopper comprising:

the drip stopper is insertable into a neck of the opened bottle, and the drip stopper includes a substantially cylindrical wall having an axial length, the wall defines an insertion part which in an inserted state extends into the bottle neck, a pouring-out part which in the inserted state protrudes above an upper edge of the bottle neck, a plurality of rectangular, radially outwardly oriented position elements between the insertion part and the pouring-out part and comprising an axially parallel nook-shaped recess which extends over the entire axial length of the wall.

2. The drip stopper according to claim 1 wherein the recess has an approximately U-shaped cross-section.

3. The drip stopper according to claim 1 wherein the recess has an approximately V-shaped cross-section.

4. The drip stopper according to claim 2 wherein the recess has an arch-shaped or bent rear wall.

5. The drip stopper according to claim 1, further comprising position elements which are arranged outside on the wall for delimiting the insertion depth.

6. The drip stopper according to claim 1 further comprising guide elements which are arranged below on the wall and facilitate insertion in a narrow bottleneck.

7. A packaging for drip stoppers according to claim 1 comprising annular indentations in a carrier element with columns concentrically arranged in each indentation, wherein a depth of the indentations is greater than a height of a stack of drip stoppers to be received.

8. The drip stopper according to claim 1 wherein the bottle is a wine bottle.

* * * * *